United States Patent [19]

Ogata et al.

[11] 4,396,856

[45] Aug. 2, 1983

[54] HIGH-PRESSURE SODIUM LAMP

[75] Inventors: Yoshiro Ogata, Ibaraki; Haruo Yamazaki, Moriyama; Takashi Ikeda, Takatsuki, all of Japan

[73] Assignee: Matsushita Electronics Corporation, Osaka, Japan

[21] Appl. No.: 208,303

[22] Filed: Nov. 19, 1980

[30] Foreign Application Priority Data

Nov. 24, 1979 [JP] Japan ..... 54-152309

[51] Int. Cl.[3] ..... H01J 17/04; H01J 61/06

[52] U.S. Cl. ..... 313/632; 313/333; 313/616

[58] Field of Search ..... 313/213, 211, 212, 216, 313/217, 333, 346 R, 206, 207

[56] References Cited

U.S. PATENT DOCUMENTS

| | | | |
|---|---|---|---|
| 3,170,081 | 2/1965 | Rokosz | 313/213 |
| 3,670,195 | 6/1972 | Kamegaya et al. | 313/213 X |
| 4,052,634 | 10/1977 | Kok | 313/213 X |
| 4,321,503 | 3/1982 | Bhalla | 313/211 |

FOREIGN PATENT DOCUMENTS

| | | | |
|---|---|---|---|
| 106771 | 3/1939 | Australia | 313/211 |
| 52-73581 | 6/1977 | Japan | 313/211 |

*Primary Examiner*—Alfred E. Smith
*Assistant Examiner*—K. A. Wieder
*Attorney, Agent, or Firm*—Burgess, Ryan & Wayne

[57] ABSTRACT

Each of the electrodes at the ends of an arc tube filled with a buffer gas, metal and sodium comprises an electrode core, an electrode coil wound around the core, an electron-emitting means disposed in the annular space between the electrode core and electrode coil and a shielding means disposed in said annular space in such a way that the electron-emitting means is shielded from exposure to the discharge space in the arc tube. The ratio h/d is determined such that $0.8 \leqq h/d \leqq 5.4$, where h is the length in mm of the portion of the electrode core extended beyond the inner end of the shielding means or the innermost coil of the electrode coil; and d is the diameter in mm of the electrode core.

The arc spots can be held to remain on the end faces of the electrode cores during lamp operation so that variations in electrical and optical characteristics can be almost eliminated.

4 Claims, 3 Drawing Figures

HIGH-PRESSURE SODIUM LAMP

BACKGROUND OF THE INVENTION

The present invention relates to generally a high-pressure sodium lamp of the type whose transparent or translucent arc tube contains a metal such as mercury, cadmium or the like, which vaporizes to form the buffer gas, and sodium, and more particularly the electrodes of the arc tube.

In general, the electrodes of the high-pressure sodium lamps comprise an electrode core and an electrode coil wound around the electrode core in such a way that the electrode core is extended beyond the innermost electrode coil by a predetermined length. One end of the electrode coil, one end of a body of electron-emitting materials or one end of an inner coil carrying the electron-emitting materials (the body of electron-emitting materials and the inner coil are referred to as "the electron-emitting means" hereinafter in this specification) is exposed to the discharge space in which an arc is established, so that at each electrode, the arc spot; that is, the point of contact between the arc and the electrode fluctuates between the end face of the electrode core and the cylindrical surface thereof, one end of the electrode coil or especially one end of the electron-emitting means. As a result, sputtering of the electrode coil and evaporation of the electron-emitting means are accelerated to a considerably higher degree so that tube blackening is accelerated accordingly. In addition, even when a constant voltage is supplied through a stabilizer or ballast, the arc length varies, resulting in the variations in lamp voltage and electrical characteristics of the lamp. Furthermore, the arc spot fluctuation causes variations in operating temperature of the electrode which in turn cause temperature variations the coldest spot in the arc tube. As a consequence, variations in vapor pressure in the arc tube follow in the high-pressure sodium lamps of the saturated vapor type so that lamp voltage variations occur during the lamp life. As a consequence, the electrical as well as optical characteristics vary, so that the factors which influence the lamp life are adversely affected and consequently the lamp life is considerably shortened.

The above-described variations in lamp characteristics due to the arc spot fluctuations are especially pronounced in high-pressure sodium lamps with high-color-rendition in which the average potential gradient is higher than 20 V/cm.

One of the objects of the present invention is, therefore, to provide a high-pressure sodium lamp in which the arc spot fluctuations can be substantially suppressed during operation so that the electrical and optical characteristics of the lamp can be stabilized and the lamp life can be increased.

SUMMARY OF THE INVENTION

According to one preferred embodiment of the present invention, each of the electrodes at the ends of an arc tube filled or sealed with a buffer gas, generating metal and sodium comprises an electrode core, an electrode coil wound around the core, an electron-emitting means disposed in an annular space defined between the electrode core and coil and a shielding means disposed in the annular space in such a way that the electron-emitting means is not exposed to the discharge space, the electrode core being extended beyond the innermost end of the shielding means or the innermost coil of the electrode coil. In addition, the following dimensional relationship or ratio must be satisfied:

$$0.8 \leqq h/d \leqq 5.4$$

where h is the length in mm of the portion of the electrode core extended beyond the inner end of the shielding means or the innermost coil of the electrode coil; and d is the diameter in mm of the electrode core.

According to the present invention, therefore, the arc spots can be always maintained at the front faces of the electrode cores so that the arc length, the electrode temperature and the temperature at the coldest spot in the arc tube as well can be maintained almost constant and subsequently the variation in electrical as well as optical characteristics can be avoided, whereby the long lamp life can be ensured.

DESCRIPTION OF THE PREFERRED EMBODIMENT

Figure 1:
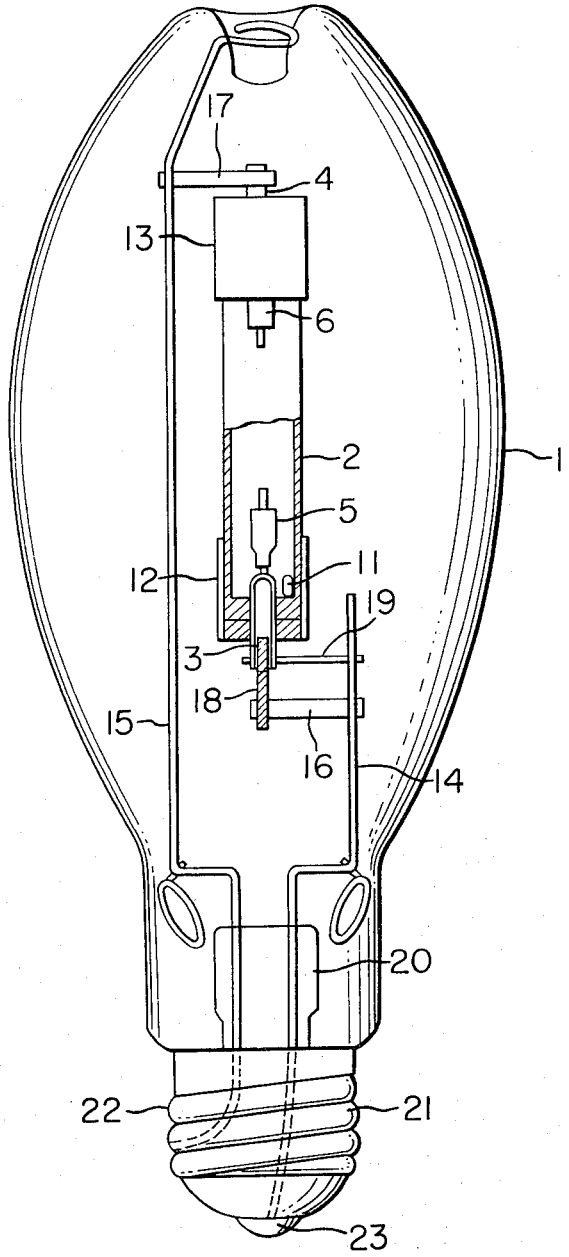
FIG. 1 is a front view, partly in section, of a preferred embodiment of a high-pressure sodium lamp in accordance with the present invention.

Referring to FIG. 1, a high-pressure sodium lamp in accordance with the present invention comprises an evacuated outer jacket 1 and an arc tube 2 as with the conventional lamps. The arc tube 2 comprises a transparent alumina tube 8 mm in inner diameter and 9.6 mm in outer diameter. Niobium tubes 3 and 4 are gas-tightly fitted or inserted through the ends of the arc tube 2 and electrodes 5 and 6 are extended from the inner ends of the niobium tubes 3 and 4, respectively, and are spaced apart from each other by at least 31 mm.

Figure 2:
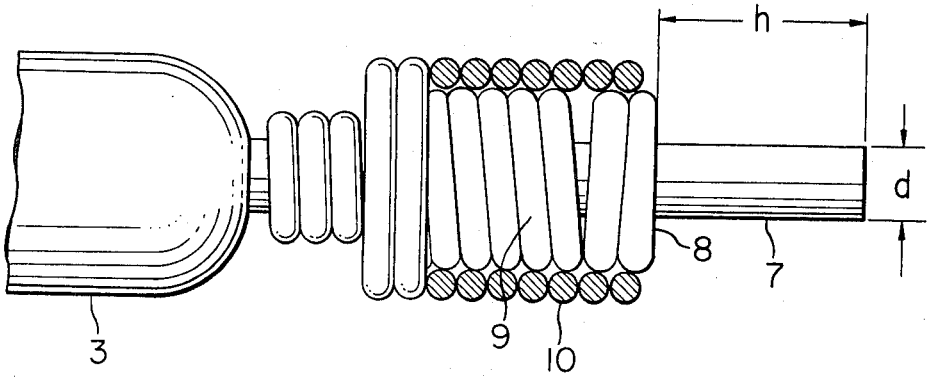
FIG. 2 is a side view, partly in section, on enlarged scale, of the electrode.

Referring next to FIG. 2, the construction of the electrode 5 will be described since the electrodes 5 and 6 are similar in construction. The electrode 5 consists of a core 7 which is made of thoriated tungsten and is 0.9 mm in diameter d. A triple-coiled (CCC) shield coil 8 which is 0.5 mm in diameter and made of tungsten is wound two turns around the core 7 from the point spaced apart by h from the free or inner end of the core 7, and an inner triple-coiled (CCC) inner coil 9, which is 0.5 mm in diameter, made of tungsten and coated with electron-emitting compounds such as $BaCO_3$, $CaCO_3$, $ThO_2$, etc., is wound six turns around the core 7 adjacent to the shield coil 8.

When a single coil is used as the shield coil 8, its weight becomes heavy and its heat capacity becomes higher so that when the lamp is started, a time interval is required to start the arc discharge after the glow discharge will become longer. During this time interval, excessive sputtering of the electrodes occurs so that the inner wall of the arc tube 2 is considerably blackened and consequently the light intensity drops and the lamp life is shortened. According to the present invention, therefore, among the recoiled or multiple-coiled coils which are light in weight and low in heat capacity, the triple-coiled filament is selected which is same as the inner triple-coiled inner coil 9.

The core 7 is extended by h=2.5 mm from the inner end of the shield coil 8. An electrode coil 10 which is 0.4 mm in diameter and is made of tungsten is wound 10 turns around the shield and inner coils 8 and 9.

Referring back to FIG. 1, sodium amalgam 11 consisting of 8 mg of sodium and 20 mg of mercury is filled in the arc tube 2 and the gas mixture comprising neon and argon is sealed at about 20 torr.

Metallic foils 12 and 13 made of tantalum are wrapped around the arc tube 2 adjacent to the ends thereof so as to surround the electrodes 5 and 6. They serve to reflect back the heat and light radiated from the arc tube 2 and more particularly from the electrodes 5 and 6 to the coldest spot at which the sodium amalgam remains so that the temperature at the coldest spot will rise. As a result, the vapor pressure in the arc tube 2 rises considerably. Furthermore, since the inner diameter of 8 mm of the arc tube 2 is considerably greater than that of a conventional high-pressure sodium lamp (150 W), the self-reversal of the sodium D lines occurs and the broadening of spectral lines in the visible range become larger. Thus, lamp color, especially color rendition superior to those attained by the conventional high-pressure sodium lamps can be obtained.

When the axial length of the metallic foils 12 and 13 are increased, the temperature at the coldest spot can be raised so that the vapor pressure in the arc tube 2 also rises. Therefore, it follows that the electrical characteristics and lamp color can be freely selected or controlled by changing the axial length of the metallic foils 12 and 13.

In this embodiment, the metallic foils 12 and 13 are 40 μm in thickness and 13.0 mm in axial length so that under the conditions that the lamp power is 150 W and the average potential gradient is maintained at from 29 to 35 V/cm; that is, the lamp voltage is maintained at from 90 to 110 V, the color temperature is maintained at about 2,500° K. and the average color rendering index Ra is maintained at higher than 80.

The arc tube 2 is supported in the outer jacket 1 by lead-in wires 14 and 15, supporting plates 16 and 17 and a supporting rod 18 made of an insulating material. The lower supporting plate 16 has its one end welded to the lead-in wire 14 and the other end securely joined to the lower end of the supporting rod 18. The upper end of the supporting rod 18 is loosely inserted into the niobium tube 3. A lead wire 19 is interconnected between the lead-in wire 14 and the niobium tube 3 so as to establish the electrical connection therebetween. One end of the upper supporting plate 17 is welded to the lead-in wire 15 while the other end thereof is welded to the upper or outer end of the upper niobium tube 4.

The lead-in wires 14 and 15 are extended through a glass stem 20 and joined to a center contact 23 and a shell or rim 22 of the base 21.

In each of the electrodes 5 and 6 of the arc tube 2, the inner coil 9 coated with the electron emitting compounds is completely surrounded by the electrode core 7, the shield core 8 and the electrode coil 10 so as to be isolated from the discharge space. In addition, part of the electron emitting compounds is sufficiently supplied to the inner end face of the core 7. Thus, during operation the arc spot is always formed at the front face of the core 7. As a result, the discharge arc length, the electrode temperature and the temperature at the coldest spot as well in the arc tube 2 can be maintained almost constant during operation so that the lamp characteristics described above can be maintained during the whole lamp life.

Figure 3:
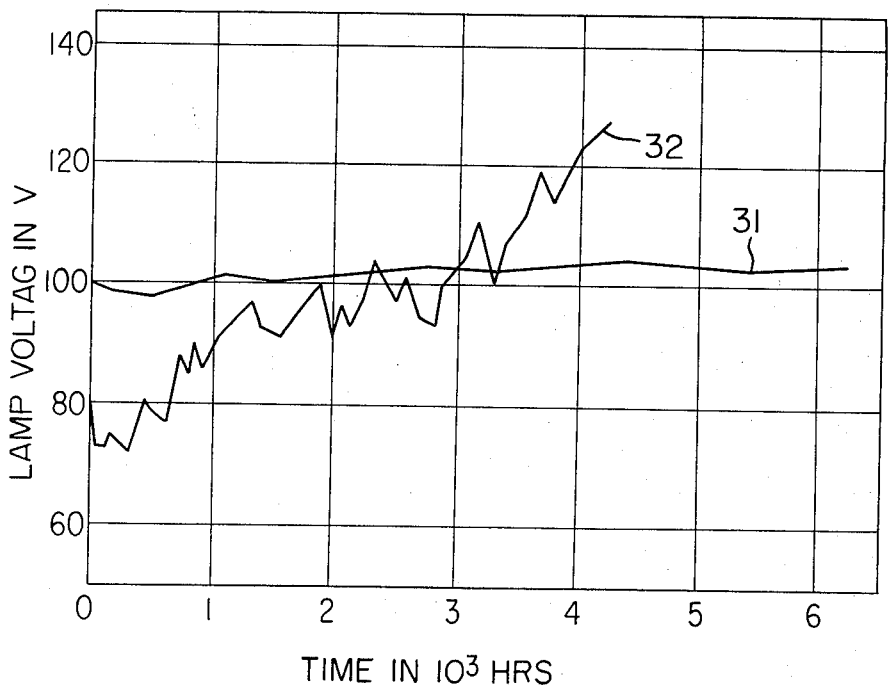
FIG. 3 is a graph showing the comparison in lamp-voltage vs. lamp operating time between the high-pressure sodium lamps of the present invention and the prior art.

The high-pressure sodium lamp with the above-described construction was subjected to the tests in which the lamp was connected in series to a single-choke type stabilizer or ballast and was supplied with a constant voltage. The resultant lamp voltage variation is shown by the curve 31 in FIG. 3. During test, the arc spot formed at the front face of the core 7 remained stationary; the variation in lamp voltage were suppressed within 7 V; the lamp color remained unchanged; and the luminous flux maintained its initial level, because the blackening of the arc tube 2 was inhibited.

In the conventional high-pressure sodium lamps, the electrodes 5 and 6 are not provided with the shield coil 8 and instead the inner coil 9 is extended inwardly. Obviously, the inner ends or the innermost coil of the inner coil 9 is exposed to the discharge space so that the arc spot shifts from the end face of the core 7 to the cylindrical surface thereof or to the exposed end of the inner coil 9 and then returns to the end face. Thus, during the lamp life, the arc spots very frequently fluctuate at and adjacent to the inner ends of the electrodes 5 and 6 so that the lamp voltage varies very sharply and quickly. As a result, the average lamp voltage steeply increases so that the lamp color varies over a wide range and the blackening of the arc tube is accelerated, resulting in the sharp drop in lamp or luminous flux.

TABLE 1

(150 W: rated lamp voltage, 100V; turned on for 9000 hrs)

| Electrode | | | | Maximum |
|---|---|---|---|---|
| Core diameter d (mm) | Extension of core h (mm) | h/d | Shield coil | variation of lamp voltage ΔV (V) |
| 0.9 | 0.55 | 0.6 | provided | 31 |
| | 0.7 | 0.8 | provided | 20 |
| | 1.0 | 1.1 | provided | 15 |
| | 1.5 | 1.7 | provided | 11 |
| | 2.5 | 2.8 | provided | 7 |
| | 3.5 | 3.9 | provided | 9 |
| | 4.5 | 5.0 | provided | 15 |
| | 4.9 | 5.4 | provided | 20 |
| | 5.0 | 5.6 | provided | 21 |
| | 5.5 | 6.1 | provided | 28 |
| | 2.5 | 2.8 | not provided | 64 |

As shown in TABLE 1, even when the shield coil 8 is provided, when the ratio h/d is less than 0.8 or larger than 5.4, wide variation of lamp voltage results and consequently lamp color widely fluctuates. According to the results of the experiments conducted by the inventors, when the maximum lamp variation ΔV relative to the rated lamp voltage is less than 20 V, the variation in lamp color can be tolerated and when the lamp voltage variation ΔV is less than 15 V, the variation in lamp color can be minimized. From TABLE 1 it is seen that the lamp voltage variation of the lamp without the shield coil is excessively high as compared with those with the shield coil.

The reason why the wide variation of lamp voltage occurs when the ratio h/d is less than 0.8 or larger than 5.4 is as follows. When the extension h is short, the distance between the end face of the core 7 and the innermost coil of the inner coil 9 is shortened accordingly so that the arc spot shifts to the portion of the shield coil 8 which is exposed to the discharge space and then returns to the initial point; that is, the arc spot fluctuates. On the other hand, when the extension h is long, the supply of electron-emitting materials from the inner coil 9 to the end face of the core 7 through the core is insufficient so that the arc spot fluctuates.

TABLE 2

(rated lamp voltage, 100V; turned on for 9000 hrs)

| Watts of lamp | Electrode: Core diameter d (mm) | Electrode: Extension h (mm) | Electrode: h/d | Electrode: Shield coil | Maximum variation of lamp voltage ΔV (V) |
|---|---|---|---|---|---|
| 70 W | 0.7 | 0.5 | 0.7 | provided | 27 |
| | | 0.55 | 0.8 | provided | 20 |
| | | 0.7 | 1.0 | provided | 17 |
| | | 1.0 | 1.4 | provided | 13 |
| | | 1.5 | 2.1 | provided | 10 |
| | | 2.0 | 2.9 | provided | 8 |
| | | 3.0 | 4.3 | provided | 11 |
| | | 3.5 | 5.0 | provided | 15 |
| | | 3.8 | 5.4 | provided | 20 |
| | | 4.0 | 5.7 | provided | 25 |
| | | 2.0 | 2.9 | not provided | 60 |
| 400 W | 1.2 | 0.5 | 0.4 | provided | 38 |
| | | 1.0 | 0.8 | provided | 20 |
| | | 2.0 | 1.7 | provided | 11 |
| | | 3.0 | 2.5 | provided | 9 |
| | | 4.0 | 3.3 | provided | 10 |
| | | 5.0 | 4.2 | provided | 11 |
| | | 6.0 | 5.0 | provided | 15 |
| | | 6.5 | 5.4 | provided | 20 |
| | | 7.0 | 5.8 | provided | 26 |
| | | 3.0 | 2.5 | not provided | 61 |

As shown in TABLE 2, the excellent characteristics can be obtained also with the core diameters of 0.7 and 1.2 mm. When the electron-emitting materials on the inner coil 9 is completely surrounded with the core 7, the shield coil 8 and the electrode coil 10 and is isolated completely from the discharge space and when the ratio h/d is equal to or larger than 0.8 and equal to or less than 5.4; that is, $0.8 \leqq h/d \leqq 5.4$, excellent characteristics can be ensured not only with the so-called high-pressure sodium lamps with high-color-rendition in which the average potential gradient is maintained higher than 20 V/cm but also with the general high-pressure sodium lamps.

As seen from TABLES 1 and 2, the variation of lamp voltage is remarkably suppressed especially when $1.1 \leqq h/d \leqq 5.0$, whereby excellent lamp characteristics and performance can be ensured.

So far the shielding means has been described as consisting of the triple-coiled coil 10, but it is to be understood that it may be in the form of a metallic ring or any other suitable form and that the present invention is not limited only to the electrode consisting of the triple-coiled coil 10. The electron-emitting materials have been described as being coated on the inner coil 9, but it is to be understood that the present invention is not limited thereto and that the inner coil 9 is eliminated and instead the electron-emitting materials is disposed in the above-described annular space of the electrode 5.

In this embodiment, the shielding means; that is, the shield coil 8 has been described and shown as being extended beyond the innermost coil of the electrode coil 10, but it is to be understood that the electrode coil 10 may be extended beyond the shield coil 8 or the innermost coils of the shield coil and inner electrode coils 8 and 9 may be aligned.

What is claimed is:

1. A saturated vapor type high-pressure sodium lamp of the type in which enclosed in an outer jacket is a transparent or translucent arc tube which has electrodes at its ends and in which are sealed a buffer gas, metal and sodium, the average potential gradient in said arc tube being greater than 20 volts per centimeter, wherein each of said electrodes comprises an electrode core, an electrode coil wound around said electrode core, electron-emitting means disposed in the space between said electrode core and said electrode coil, and a shielding means comprising a multiple-coiled coil disposed in said space between said electrode core and said electrode coil in such a way that said electron-emitting means is shielded from exposure to the discharge space in said arc tube; and the following dimensional relationship is satisfied $$0.8 \leqq h/d \leqq 5.4$$

where h is the length in mm of the portion of said electrode core extended beyond the inner end of said shielding means or the innermost coil of said electrode coil; and d is the diameter in mm of said electrode core.

2. A high-pressure sodium lamp as set forth in claim 1 wherein said electron-emitting means is coated on an inner coil disposed in said space between said electrode core and said electrode coil.

3. A high-pressure sodium lamp as set forth in claim 1 wherein said electron-emitting means comprising electron-emitting materials.

4. A high-pressure sodium lamp as set forth in claim 1 wherein said dimensional relationship h/d is between 1.1 and 5.0.

* * * * *